US006371143B1

(12) United States Patent
Swetish

(10) Patent No.: US 6,371,143 B1
(45) Date of Patent: Apr. 16, 2002

(54) CANOPY STRUCTURE

(75) Inventor: Thomas R. Swetish, Racine, WI (US)

(73) Assignee: Johnson Outdoors Inc., Sturtevant, WI (US)

( * ) Notice: Subject to any disclaimer, the term of this patent is extended or adjusted under 35 U.S.C. 154(b) by 0 days.

(21) Appl. No.: 09/307,651

(22) Filed: May 7, 1999

(51) Int. Cl.[7] ..... E04H 15/40; E04H 15/42
(52) U.S. Cl. ..... 135/125; 135/128; 135/114
(58) Field of Search ..... 135/124, 125, 135/126, 128, 114

(56) References Cited

U.S. PATENT DOCUMENTS

| | | | | |
|---|---|---|---|---|
| 2,055,044 A | * | 9/1936 | Nelson | |
| 2,266,853 A | * | 12/1941 | Dabney | |
| 2,475,515 A | * | 7/1949 | Potter | |
| 2,879,553 A | * | 3/1959 | Keating | |
| 2,961,802 A | | 11/1960 | Mongan et al. | |
| 3,448,748 A | * | 6/1969 | Walrave | 135/114 |
| 3,726,294 A | | 4/1973 | Huddle | |
| 3,886,961 A | | 6/1975 | Geiger et al. | |
| 4,036,244 A | | 7/1977 | Huddle | |
| 4,063,830 A | * | 12/1977 | Ban | 135/114 |
| 4,092,992 A | | 6/1978 | Huddle | |
| RE30,044 E | | 7/1979 | Huddle | |
| 4,269,210 A | * | 5/1981 | Marks | |
| 4,404,980 A | | 9/1983 | Wade | |
| 4,557,284 A | | 12/1985 | Bray | |
| 4,858,635 A | * | 8/1989 | Eppenbach | 135/104 |
| 4,966,178 A | * | 10/1990 | Eichorn | 135/104 |
| 5,014,728 A | | 5/1991 | Arnold | |
| 5,080,123 A | | 1/1992 | Stein | |
| 5,117,852 A | * | 6/1992 | Bryant | 135/104 |
| 5,273,142 A | * | 12/1993 | Weber | |
| 5,370,145 A | * | 12/1994 | Wu | 135/127 |
| 5,390,688 A | | 2/1995 | Lipman | |
| 5,579,799 A | * | 12/1996 | Zheng | 135/126 |
| 5,590,674 A | | 1/1997 | Eppenbach | |
| 5,642,750 A | * | 7/1997 | Brown et al. | 135/137 |
| 5,832,943 A | * | 11/1998 | Johnson | 135/124 |
| 5,927,311 A | * | 7/1999 | Jager | 135/124 |

FOREIGN PATENT DOCUMENTS

| | | | |
|---|---|---|---|
| FR | 1301413 | * 12/1990 | 135/114 |
| FR | 2648852 | * 12/1990 | 135/125 |

OTHER PUBLICATIONS

J.T. Inglis & Sons Catalog—"Ranger Series" (4 Pages).

* cited by examiner

*Primary Examiner*—Robert Canfield
(74) *Attorney, Agent, or Firm*—Foley & Lardner

(57) ABSTRACT

A canopy structure includes a plurality of support beams and a plurality of flexible connecting panels therebetween. Each of the plurality of support beams is formed by an elongate spine extending along an arc and first and second tension panels extending from the strip non-parallel to one another. The connecting panels extend between and interconnect the first and second tension panels of adjacent support beams, respectively. In the exemplary embodiment, each support beam includes a sleeve between the first and second tension panels, wherein the sleeve removably receives the spine. Each spine preferably comprises a strip that has a longitudinal length and a transverse width extending in a plane, wherein the strip is resiliently flexible in a direction non-parallel the plane and inflexible in a direction parallel to the plane and wherein the strip is arcuately deformed along its longitudinal length when inserted into the sleeve. In the exemplary embodiment, the first and second support beams cross one another at an apex. The first and second tension panels of each support beam divergently extend from the spine at a first acute angle proximate the apex and at a second greater acute angle distant the apex.

38 Claims, 4 Drawing Sheets

FIG. 4
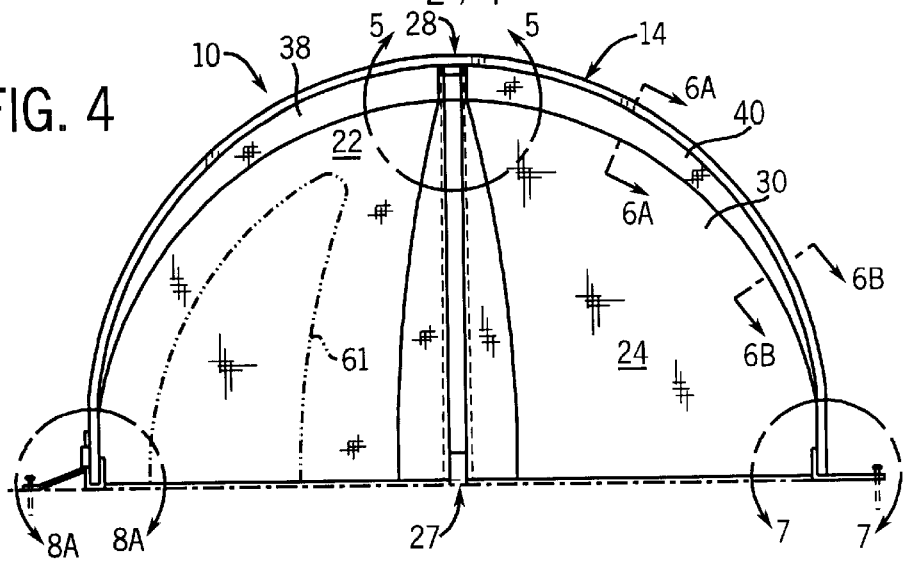
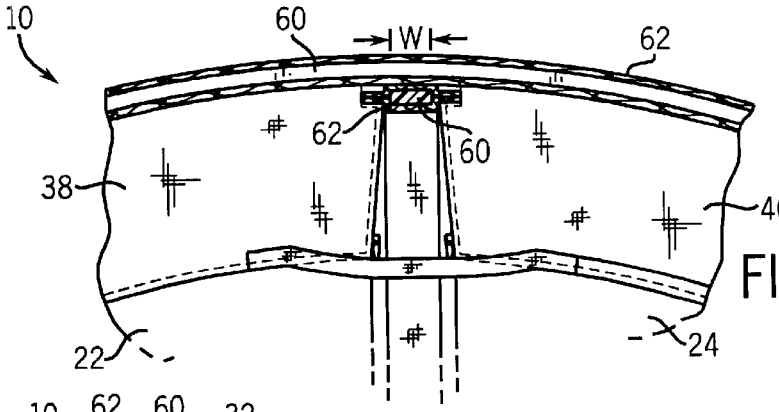
FIG. 5
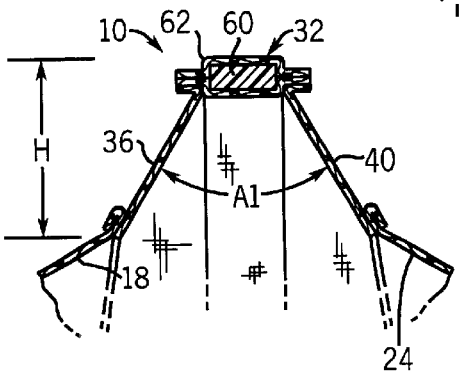
FIG. 6A
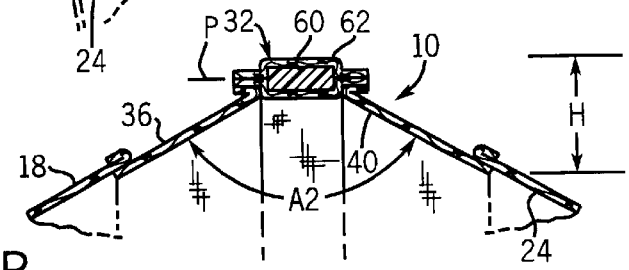
FIG. 6B

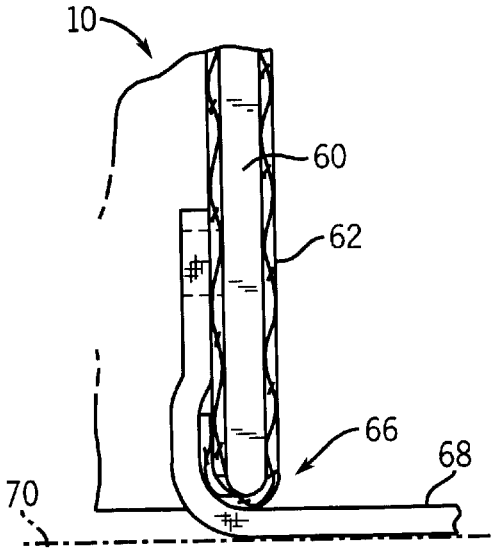
FIG. 7
FIG. 9
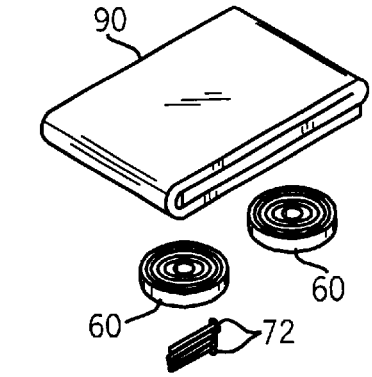
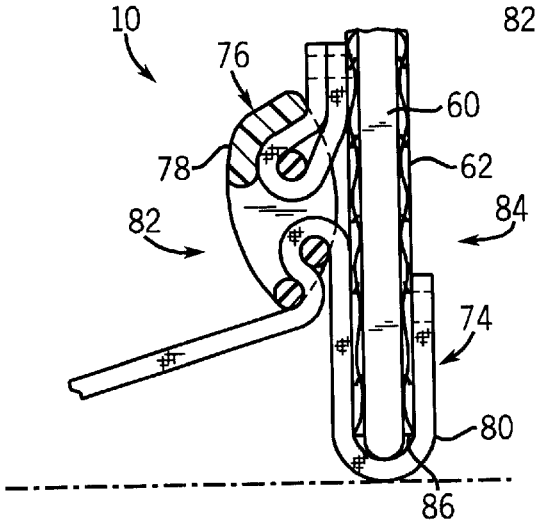
FIG. 8A
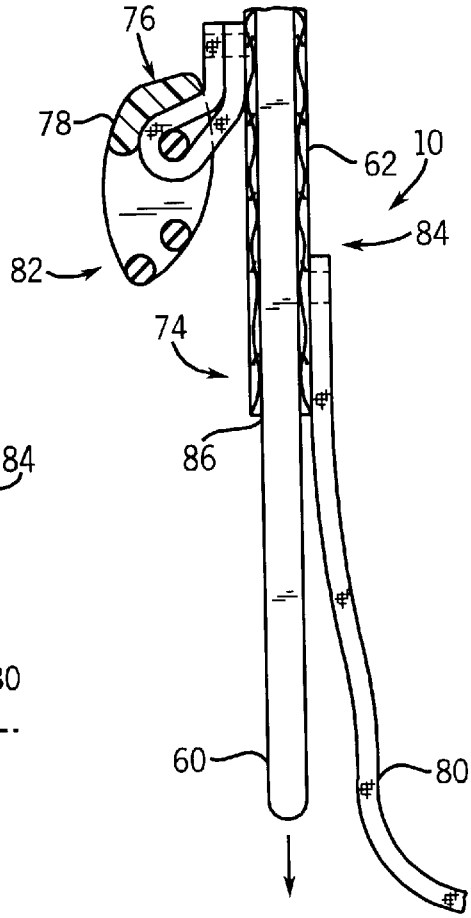
FIG. 8B

CANOPY STRUCTURE

FIELD OF THE INVENTION

The present invention relates to canopy structures such as tents, elevated coverings and various other shelters. In particular, the present invention relates to the canopy structure being able to withstand large loads with minimal bending and twisting.

BACKGROUND OF THE INVENTION

Canopy structures such as tents, elevated coverings and various other shelters come in a variety of sizes, shapes and configurations and are used for a multitude of purposes. Some canopy structures extend to the ground and provide shelter during such activities such as camping. Other canopy structures are elevated above the ground by poles to provide cover and protection against sun, rain and wind for such activities as parties and receptions. Many of today's conventional canopy structures include a flexible, light weight canopy having a plurality of flexible panels and a plurality of sleeves which removable receive elongate poles that are inserted through the sleeves and arcuately bent. As the poles attempt to return to their natural linear shape, the poles place the sleeves and the canopy in tension to support the canopy. To enable the canopy structure to be collapsed, the poles are typically formed from multiple pole segments which have axial ends connected to one another and which are interconnected by an internal bunny cord. Upon removal from the sleeves, the pole segments of each pole are separated and folded for storage.

Although such canopies and poles are commonly used, such canopy structures have several distinct drawbacks. First, such canopy structures are not capable of withstanding large loads. Excessive loading of the poles typically breaks or permanently bends the poles. Second, the poles of such canopy structures occupy significant space, even when folded and collapsed. Third, the poles of such canopy structures are relatively expensive to manufacture and replace.

Thus, there is a continuing need for a canopy structure including support members which withstand larger loads, which are easily collapsed for compact storage and which are inexpensively and easily manufactured and replaced.

SUMMARY OF THE INVENTION

The present invention provides a canopy structure, including a plurality of support beams and a plurality of flexible connecting panels therebetween. Each of the plurality of support beams is formed by an elongate spine extending along an arc and first and second tension panels extending from the spine non-parallel to one another. The flexible connecting panels extend between and interconnect first and second tension panels of adjacent support beams, respectively.

The present invention also provides a canopy structure including first and second elongate strips crossing one another and interconnected by at least one flexible panel between the first and second strips. The first strip has a first longitudinal length and a first transverse width extending within a first plane. The first strip is resiliently flexible in a direction non-parallel to the plane and inflexible in a direction parallel to the plane. The first strip is arcuately deformed along its longitudinal length. The second elongate strip crosses the first elongate strip. The second elongate strip has a second longitudinal length and a second transverse width extending within a second plane. The second strip is resiliently flexible in a direction non-parallel to the second plane and inflexible in a direction parallel to the second plane. The second strip is arcuately deformed along its longitudinal length. The at least one flexible panel is coupled to the first and second strips between the first and second strips.

The present invention also provides a canopy structure including a canopy and a plurality of elongate spines. The canopy includes a plurality of arcuately extending sleeves, first and second tension panels extending from each sleeve and a plurality of flexible connecting panels extending between the first and second tension panels of adjacent sleeves. The first and second tension panels extend from each sleeve non-parallel to one another. Each of the plurality of spines is removably received within a corresponding sleeve, whereby the spines support the canopy when inserted into the sleeves and whereby removal of the spines from the sleeves enable the canopy to be collapsed.

BRIEF DESCRIPTION OF THE DRAWINGS

FIG. 4 is a sectional view of the canopy structure of FIG. 1 taken along lines 4—4.

FIG. 5 is a sectional view of the canopy structure of FIG. 4 taken along lines 5—5.

FIG. 6A is a sectional view of the canopy structure of FIG. 4 taken along lines 6A—6A.

FIG.6B is a sectional view of the canopy structure of FIG. 4 taken along lines 6B—6B.

FIG. 7 is a greatly enlarged sectional view of the canopy structure of FIG. 4 taken along lines 7—7.

FIG. 8A is a greatly enlarged sectional view of the canopy structure of FIG. 4 taken along lines 8A—8A.

FIG. 8B is a greatly enlarged sectional view of the canopy structure of FIG. 4 taken along lines 8A—8A illustrating disengagement of a retention device and removal of a strip from the canopy structure.

FIG. 9 is a perspective view of the canopy structure of FIGS. 1–8 collapsed into a folded canopy, a pair of coiled strips and a plurality of stakes.

DETAILED DESCRIPTION OF THE PREFERRED EMBODIMENT

Figure 1:
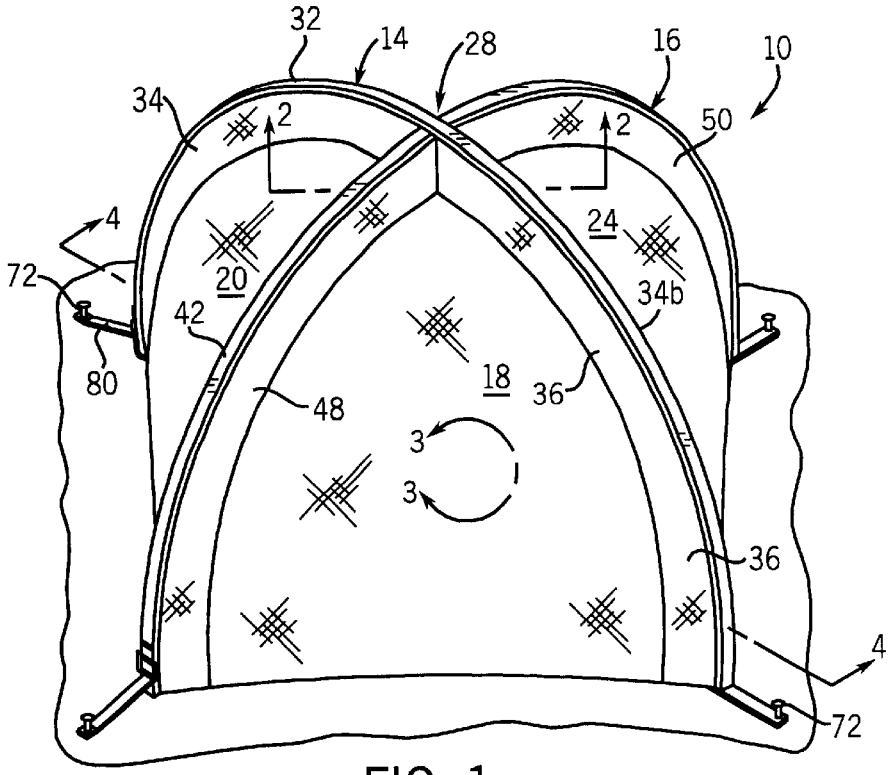
FIG. 1 is top perspective view of one exemplary embodiment of a canopy structure of the present invention.

FIG. 1 is a perspective view of an exemplary canopy structure 10 configured for use as a shelter. As will be appreciated, canopy structure 10 may alternatively be configured for being elevated by poles or other structures to provide a cover for receptions and parties. Canopy structure 10 generally includes supporting arches 14, 16 and flexible connecting membranes or panels 18, 20, 22 (shown in FIG. 2) and 24. Arches 14, 16 cross one another at apex 28 and support panels 18, 20, 22 and 24 which extend between arches 14 and 16 to define an interior 30 (shown in FIG. 4).

Arches 14 and 16 are each three dimensional and are substantially identical to one another. Arch 14 generally includes spine 32 and tension panels 34, 36, 38 and 40 (shown in FIG. 2). Arch 16 generally includes spine 42 and tension panels 44, 46, 48 and 50 (shown in FIG. 2). Spines 32 and 42 each comprise elongate slightly flexible members which extend along in an arc along arches 14 and 16. In the exemplary embodiment, spine 32 crosses over spine 42 at apex 28. Spines 32 and 42 serve as a structural backbone of canopy structure 10.

Figure 2:
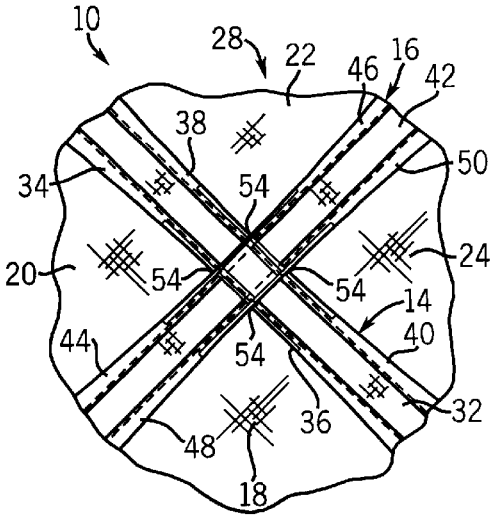
FIG. 2 is a fragmentary sectional view of the canopy structure of FIG. 1 taken along lines 2—2.

Tension panels 34, 36, 38 and 40 extend from spine 32, while tension panels 44, 46, 48 and 50 extend from spine 42. Tension panels 34 and 36 of arch 14 extend on opposite sides of apex 28 opposite tension panels 38 and 40, respectively. Likewise, tension panels 44 and 46 of arch 16 extend on opposite sides of apex 28 opposite tension panels 48 and 50, respectively. As shown by FIG. 2, tension panels 34 and 44, tension panels 36 and 48, tension panels 38 and 46 and tension panels 40 and 50 are preferably joined to one another along parallel and substantially vertical seams 54 at apex 28.

Connecting panels 18, 20, 22 and 24 extend between arches 14 and 16 to provide membranous walls of canopy structure 10. Panel 18 extends between and is connected to tension panels 36 and 48; panel 20 extends between and is connected to tension panels 34 and 44; panel 22 extends between and is connected to tension panels 38 and 46; and panel 24 extends between and is connected to tension panels 40 and 50. Each of connecting panels 18, 20, 22 and 24 is formed from a flexible lightweight material such as nylon. Panels 18, 20, 22 and 24 serve as the main walls forming canopy structure 10 to shield interior 30 from sun, rain, wind and other harmful elements. As shown by FIG. 4, panel 22 preferably includes a door 61. As will be appreciated, door 61 may have various sizes and shapes. Moreover, door 61 may be omitted when canopy structure 10 is elevated by poles or other elevating members.

Figure 3:
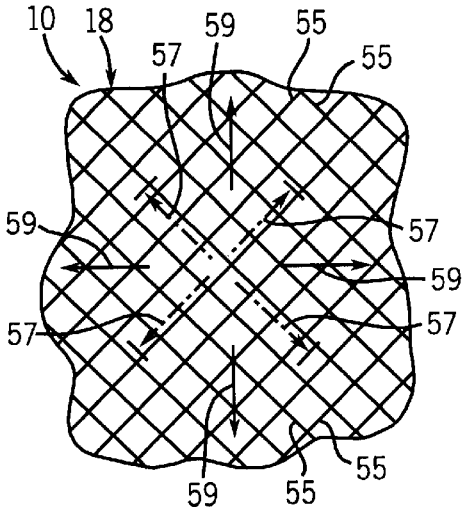
FIG. 3 is a greatly enlarged fragmentary side elevational view of the canopy structure of FIG. 1 taken lines 3—3.

As best shown by FIG. 3, connecting panels 18, 20, 22 and 24 are preferably formed from a fabric material having perpendicular weaves 55. The fabric forming each of connecting panels 18, 20, 22 and 24 is generally not stretchable in directions 57 extending parallel to weaves 55 and is generally stretchable in directions 59 extending oblique to weaves 55. The material forming connecting panels 18, 20, 22 and 24 is preferably connected to and between arches 14 and 16 such that weaves 55 extend diagonally between arches 14 and 16. As a result, each of connecting panels 18, 20, 22 and 24 has the greatest resiliency and stretchability in directions horizontally extending between arches 14 and 16 and in directions extending vertically from base 27 to apex 28. At the same time, however, connecting panels 18, 20, 22 and 24 are least stretchable in directions diagonally extending between arches 14 and 16. It has been discovered that this orientation of weaves 55 enables canopy structure 10 to best adapt to loads typically placed upon arches 14, 16 as well as connecting panels 18, 20, 22 and 24. Although less optimal, other orientations of weaves 55 may be utilized and other non-fabric materials may alternatively be used for connecting panels 18, 20, 22 and 24.

Canopy structure 10 maintains its structural integrity when supporting large loads. In particular, when large loads or forces are exerted against spines 32 and 42, tension panels 34, 36, 38, 40, 44, 46, 48 and 50 are simultaneously placed in tension. As a result, arches 14 and 16, formed by spines 32, 42 and tension panels 34–40 and 44–50, function as thick support beams or trusses having a thickness substantially equal to the distance by which tension panels 34–40 and 44–50 extend away from spines 32 and 42, respectively. As a result, the load withstanding capability of arches 14 and 16 is much greater than the load withstanding capability of spines 32 and 42 alone. This in turn enables spines 32 and 42 to be made from materials having a greater flexibility as compared to conventional relatively more rigid tent poles. Consequently, spines 32 and 42 may be formed from materials which are not susceptible to kinking or permanent deformation. Although arches 14 and 16 have strength and rigidity analogous to relatively thick three dimensional support beams, arches 14 and 16 are light weight, can be easily and inexpensively manufactured and are capable of being formed by simple spines having tension panels connected thereto.

FIGS. 4, 5, 6A and 6B illustrate spine 32 and tension panels 36, 40 of arch 14 in greater detail. Referring to FIGS. 4, 6A and 6B, tension panels 36 and 40 divergently extend away from one another from spine 32 to flexible connecting panels 18 and 24, respectively. As shown by FIGS. 6A and 6B, tension panels 36 and 40 diverge from one another at a first acute angle A1 proximate apex 28 and at a second greater acute angle A2 distant apex 28. In particular, the acute angle A formed between tension panels 36 and 40 increases as tension panels 36 and 40 extend farther from apex 28. As a result, the height H of arch 14, defined from the top of spine 32 to the juncture of tension panels 36, 40 with connecting panels 18, 24, decreases towards base 27 of canopy structure 10. Because arch 14 has a greater height H proximate apex 28, arch 14 is stronger and more capable of withstanding heavy loads towards apex 28. This is advantageous since heavy loads, such as snow, are more likely to be placed upon canopy structure 10 at apex 28. Because the height H of arch 14 is reduced and the acute angle A between tension panels 36 and 40 is greater towards base 27, arch 14 is wider towards base 27 and is more resistant to torsional forces and twisting. As a result, canopy structure 10 is more stable at base 27 where torsional forces are typically the greatest.

In the exemplary embodiment, arch 14 has a height H of approximately 5 inches at apex 28 and a height H of approximately 3.5 inches at base 27. As discussed above, it has been discovered that increasing the height H of arch 14 also increases its strength and ability to withstand loads. In the exemplary embodiments, tension panels 36 and 40, extend substantially parallel to one another from spine 32 at apex 28. The angle A between tension panels 36 and 40 gradually increases towards base 27 at which point tension panels 36 and 40 extend substantially coincident with one another. Although not described in detail for purposes of brevity, tension panels 34, 38 are substantially identical to tension panels 36, 40 in this respect. Furthermore, spine 42 and tension panels 44, 48 and 46, 50 of arch 16 are also similar in construction.

Although arches 14 and 16 are illustrated as having tension panels that extend from their respective spines parallel to one another at apex 28 and that gradually diverge away from one another towards base 27, arches 14 and 16 may have alternative configurations while still providing high strength and large load capacities at apex 28 and high degrees of torsional resistance at base 27. For example, although somewhat less optimal, tension panels 36, 40 and tension panels 34, 38 of arch 14 may alternatively converge towards one another from spine 32 at or partially across apex 28 while still diverging from one another towards base 27. In addition, arch 14 may alternatively include a single tension panel extending from spine 32 and connected to both adjacent connecting panels at or proximate to apex 28 while including opposing divergent tension panels extending from the single tension panel towards base 27. Similar modifications may likewise be made to arch 16. Various other alternative configurations and embodiments are contemplated.

As further shown by FIGS. 4, 5, 6A and 6B, spine 32 of arch 14 comprises an elongate band or strip 60 coupled to tension panels 36 and 40. Strip 60 comprises an elongate flexible member having sufficient structural strength to support the tension panels and the connecting panels of canopy structure 10 when employed with other strips. Strip 60 generally has a longitudinal length and a transverse width W extending in an arcuate plane P. Strip 60 is resiliently flexible such that strip 60 returns or attempts to return to its original shape. Strip 60 is inflexible in a direction parallel to the plane P. In the exemplary embodiment, strip 60 linearally extends along its longitudinal length and is arcuately deformed or bent when secured to tension panels 36 and 40. As a result, strip 60 acts as a spring and applies a resilient outward force to tension panels 36 and 40 as well as connecting panels 18, 24. This outward force places connecting panels 36, 40 and tension panels 36, 40 connecting panels 18, 24 in tension. Strip 60 is preferably formed from an elongate extruded band of strong, yet flexible material such as fiberglass or glass-filed polycarbonate. Strip 60 preferably has the thickness of about 0.2 inches and a transverse width of approximately one inch. In the exemplary embodiment, strip 60 preferably has a rectangular cross section. As will be appreciated, the longitudinal length of strip 60 depends upon the size of structure 10. Moreover, strip 60 may be formed from a variety of alternative materials, including both plastics and metals such that strip 60 supports canopy structure 10 while resiliently flexing under load. Moreover, strip 60 may alternatively have an oval cross section, a triangular cross section or various other cross sections wherein strip 60 has a longitudinal length and a transverse width extending in a plane and wherein strip 60 is resiliently flexible in a direction non-parallel to the plane and inflexible to a direction parallel to the plane. Although less desirable due to its torsional resistance and reduced lateral loading capacity, spine 32 may alternatively comprise a rod or other member with a circular cross section. Furthermore, spine 32 may include an elongate supporting member such as a strip or rod which is configured to naturally extend along an arc but which is resiliently flexible.

As further shown by FIGS. 4, 5, 6A and 6B, strip 60 is coupled to tension panels 36 and 40 by sleeve 62. Sleeve 62 extends between and is coupled to tension panels 36 and 40 to removably couple strip 60 to tension panels 36 and 40. In the exemplary embodiment, sleeve 62 retains strip 60 such that the transverse width W of strip 60 extends from tension panel 36 to tension panel 40. Sleeve 62 extends along a substantial portion of the longitudinal length of strip 60 to securely retain strip 60 in place. Alternatively, sleeve 62 may be composed of several individual sleeves or sleeve segments spaced from one another along the longitudinal length of strip 60 for coupling strip 60 to tension panels 36 and 40 such that strip 60 is partially exposed. In alternative embodiments, strip 60 may be exposed along the interior or the exterior of canopy structure 10. Although sleeve 62 couples strip 60 relative to tension panels 36, 40, strip 60 may alternatively be coupled to tension panels 36 and 40 indirectly by various other structures or may be coupled directly to tension panels 36 and 40 by various well-known fasteners, adhesives, weldments and the like. Although not described in detail for purposes of brevity, arch 16 and spine 42 are substantially identical to arch 14 and spine 32.

In the exemplary embodiment, sleeve 62 is configured to slidably receive strip 60 such that strip may be removed from sleeve 62 to collapse canopy structure 10. As best shown by FIGS. 7, 8A and 8B, strip 60 is removably retained within sleeve 62. In particular, as shown by FIG. 7, end 66 of sleeve 62 is closed off to retain strip 60 within sleeve 62. End 66 additionally includes an optional strap 68 fastened to sleeve 62 and configured for enabling end 66 to be staked to ground 70 by stake 72 (shown in FIGS. 1 and 4). As shown by FIG. 8A, end 74 of sleeve 62 is axially open to enable insertion of strip 60 into sleeve 62. To removably retain strip 60 within sleeve 62, canopy structure 10 includes releasable retention mechanism 76. Releasable retention mechanism 76 generally includes buckle 78 and strap 80. Buckle 78 is secured by canopy structure 10 on a first side 82 of sleeve 62 while strap 80 is secured to canopy structure 10 on a second opposite side 84 of sleeve 62. Strap 80 is configured to extend below and across axial opening 86 of sleeve 62 into engagement with buckle 78. As a result, strap 80 retains strip 60 within sleeve 62. The end of strap 80 is preferably configured for being staked to ground 70 by stake 72.

FIG. 8B illustrates a disengagement of strap 80 from buckle 78 to enable strip 60 to be removed from sleeve 62. As shown by FIG. 8B, disengagement of strap 80 from buckle 78 enables strap 80 to be withdrawn from across opening 86 such that strip 60 can be pulled through opening 86 out of sleeve 62. Arch 16 of canopy structure 10 includes similar means for retaining strip 60 within sleeve 62 of spine 42.

As shown by FIG. 9, stakes 72 may be withdrawn from ground 70 and separated from strap 68 and 80. Strips 60 may be removed from sleeves 62 of each of spines 32 and 42 such that the remaining canopy 90, substantially consisting of flexible membranes or panels, may be collapsed and folded for compact storage. Strip 60 is preferably sufficiently flexible such that strip 60 may be coiled as shown. As a result, canopy structure 10 may be easily collapsed, folded and coiled into a very compact kit that is easily stored and transported when not being used.

Figure 10:
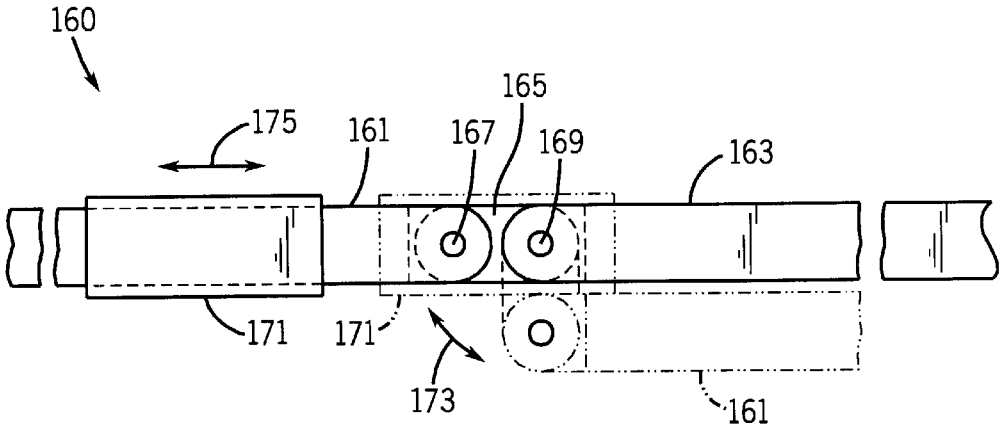
FIG. 10 is a fragmentary side elevational view of a first alternative embodiment of the strip of FIGS. 8B and 9.
Figure 11:
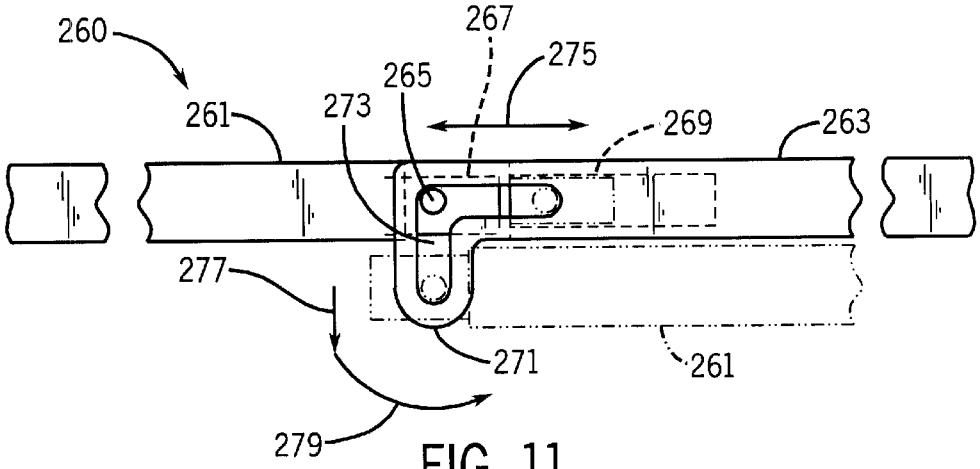
FIG. 11 is a fragmentary side elevational view of a second alternative embodiment of the strip of FIGS. 8B and 9.
Figure 12:
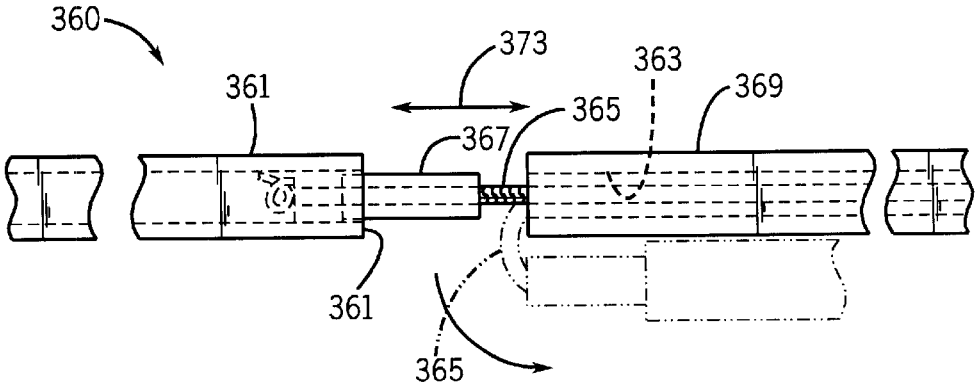
FIG. 12 is a fragmentary side elevational view of a third alternative embodiment of the strip of FIGS. 8B and 9.

FIGS. 10–12 illustrate alternative embodiments of the battens or strip 60 shown in FIGS. 5–9. Each of the illustrated alternative embodiments include mechanisms for enabling the strips to the folded rather than coiled for storage and transportation. FIG. 10 illustrates strip 160, a first alternative embodiment of strip 60. Strip 160 is similar to strip 60 except that strip 160 is formed from multiple segments 161, 163, connector segment 165, pins 167, 169 and locking mechanism 171. Segments 161 and 163 are each substantially identical to strip 60 but shorter in length. Strips 161 and 163 are interconnected by intermediate connector segment 165.

Intermediate connector segment 165 extends between adjacent ends of strip 161 and 163 and is pinned to strips 161 and 163 by pins 167 and 169. As a result, intermediate connector segment 165 and pins 167, 169 pivotably connect strips 161 and 163 to one another such that strips 161 and 163 may extend end-to end or may be folded adjacent to one another in a side-by-side relationship as shown in phantom. Consequently, strip 160 may be collapsed for storage and transportation.

Locking mechanism 171 is coupled to one of strips 161 and 163 and is moveable between a first position in which strips 161 and 160 are allowed to pivot relative to one another as indicated by arrow 173 and a second position (shown in phantom) in which locking mechanism 171 prevents pivoting of strips 161 and 163 and maintains strips 161 and 163 in an end-to-end relations. In the exemplary embodiments, locking mechanism 171 comprises a sleeve and figured to extend about strips 161 and 163 and configured to slide in the direction indicated by arrow 175. Locking mechanism 171 enables strip 160 to be placed in compression or tension while supporting spines 32, 34 and remaining canopy 90.

FIG. 11 illustrates strip 260, a second alternative embodiment of strip 60. Strip 260 is similar to strip 60 except that strip 260 includes segments 261, 263, and pin 265. Segments 261 and 263 are potentially identical to strip 60 except that segment 261 includes male projection 267 and supporting pin 265 while segment 263 includes female cavity 269 and pin guide 271. Male projection 267 extends from an axial end of segment 261 while female cavity 269 extends along an axial end of segment 263. Male projection 267 is configured to be received within female cavity 269 nonrotatably couple or lock segments 261 and 263 to one another in an end-to-end relationship. Pin guide 271 is integrally formed as part of segment 263 and extends above segment 261. Pin guide 271 includes a generally L-shaped slot 273 which receives pin 265. Alternatively, pin guide 271 may be a separate component mounted or otherwise affixed to segment 263.

Pin 265 projects from male projection 267 of segment 261 and extends at least partially through slot 273. Slot 273 and pin 265 cooperate to guide the movement of segment of 261 relative to segment 263. In particular, to axially connect segments 261 and 263 in an end-to-end relationship, segments 261 and 263 are moved towards one another in the direction indicated by arrows 275 such that male projection 267 is received with female cavity 269. Alternatively, when strip 260 has to be collapsed, segments 261 and 263 are pulled apart from one another in the direction indicated by arrow 275 to remove male projection 267 from female cavity 269. Segment 261 is then laterally moved in the direction indicated by arrow 277 and pivoted within slots 273 in the direction indicated by arrow 279 such that segments 261 and 263 extend adjacent to one another in a side-by-side relationship. As a result, strip 260 may be easily collapsed for storage and transportation or assembled for supporting the remainder of canopy structure 10.

FIG. 12 illustrates strip 360, a third alternative embodiment of strip 60. Strip 360 is similar to strip 60 except strip 360 includes segments 361, 363 and cord 365. Segments 361 and 363 are substantially identical to strip 60 except that segment 361 includes male projection 367 and segment 363 includes female cavity 369. Male projection 367 extends from an axial end of segment 361 and is configured for being nonrotatably received within female cavity 369 such that shoulder 371 abuts against the axial end of segment 363. Male projection 367 and female cavity 369 mate to secure segments 361 and 363 in a fixed end-to-end relationship such that segments 361 and 363, collectively, can be placed in tension and compression so as function substantially identical to strip 60. Segments 361 and 363 are retained together by cord 365.

Cord 365 comprises a resiliently flexible and elastic cord, commonly referred to as a bungee cord, having axial ends affixed to coupled segments 361 and 363. Cord 365 has an axial length and is affixed to segments 361 and 363 such that cord 365 resiliently biases male projection 367 into female cavity 369 to maintain segments 361 and 363 coupled to one another. In the exemplary embodiment shown in FIG. 12, cord 365 is illustrated in a stretched condition wherein cord 365 is exerting a force tending to pull male projection 367 into female cavity 369.

At the same time, however, cord 365 is stretchable to enable segments 361 and 365 to be sufficiently separated by being folded adjacent to one another. To separate segments 361 and 363 for collapse of strip 360, segments 361 and 363 are pulled apart in the direction indicated by arrow 373 such that male projection 367 is withdrawn from female cavity 369. Once male projection 367 has been withdrawn, segments 361 and 363 can be folded adjacent to one another as shown in phantom. Cord 365 prevents segments 361 and 363 from being permanently separated and from possibly being misplaced or lost. Although less desirable, cord 365 may be omitted. Once again, strip 360 may be easily collapsed for compact storage. At the same time, strip 360 is able to be placed in tension and compression to support the remainder of canopy structure 10. Although strips 160, 260, 360 have been illustrated as including two main segments secured to one another, strips 160, 260 and 360 may alternatively comprise greater than two main segments.

FIGS. 10–12 illustrate alternative embodiments of baton or strip 60 shown in FIGS. 5–9. Each of the illustrated alternative embodiments include a mechanism for enabling the strips to be folded rather than coiled for storage and transportation. FIG. 10 illustrates strip 160, a first alternative embodiment of strip 60. Strip 160 is similar to strip 60 except that strip 160 is formed from multiple segments 161, 163, connector segment 165, pins 167, 169 and locking mechanism 171. Segments 161 and 163 are each substantially identical to strip 60 but shorter in length. Segments 161 and 163 are interconnected by connector segment 165.

Connector segment 165 extends between adjacent ends of segments 161 and 163 and is pinned to segments 161 and 163 by pins 167 and 169. As a result, intermediate connector segment 165 and pins 167, 169 pivotally connect segments 161 and 163 to one another such that segments 161 and 163 may extend end-to-end or may be folded adjacent to one another in a side-by-side relationship as shown in phantom. Consequently, strip 160 may be collapsed for storage or transportation.

Locking mechanism 171 is coupled to one of segments 161 and 163 and is movable between a first position in which segments 161 and 160 are allowed to pivot relative to one another as indicated by arrow 173 and a second position (shown in phantom) in which locking mechanism 171 prevents pivoting of segments 161 and 163 and maintains segments 161 and 163 in an end-to-end relationship. In the exemplary embodiment, locking mechanism 171 comprises a sleeve and figured to extend about segments 161 and 163 and configured to slide in the direction indicated by arrow 175. Locking mechanism 171 enables strip 160 to be placed in compression and tension while supporting spines 32, 34 and remaining canopy 90.

FIG. 11 illustrates strip 260, a second alternative embodiment of strip 60. Strip 260 is similar to strip 60 except that strip 260 includes segments 261, 263 and pin 265. Segments 261 and 263 are essentially identical to strip 60 except that segment 261 includes male projection 267 supporting pin 265 while segment 263 includes female cavity 269 and pin guide 271. Male projection 267 extends from an axial end of segment 261 while female cavity 269 extends along an axial end of segment 263. Male projection 267 is configured to be received within female cavity 269 to nonrotatably couple or lock segments 261 and 263 to one another in an end-to-end relationship. Pin guide 271 is integrally formed as part of segment 263 and extends above segment 261. Pin guide 271 includes a generally Lshaped slot 273 which receives pin 265. Alternatively, pin guide 271 may be a separate component mounted or otherwise affixed to segment 263.

Pin 265 projects from male projection 267 of segment 261 and extends at least partially through slot 273. Slot 273 and pin 265 cooperate to guide the movement of segment 261 relative to segment 263. In particular, to axially connect segments 261 and 263 in an end-to-end relationship, segments 261 and 263 are moved towards one another such that male projection 267 is received within female cavity 269. Alternatively, when strip 260 has to be collapsed, segments 261 and 263 are pulled apart from one another in the direction indicated by arrow 275 to remove male projection 267 from female cavity 269. Segment 261 is then laterally moved in the direction indicated by arrow 277 and pivoted within slot 273 in the direction indicated by arrow 279 such that segments 261 and 263 extend adjacent to one another in a side-by-side relationship. As a result, strip 260 may be easily collapsed for storage and transportation or assembled for supporting the remainder of canopy structure 10.

FIG. 12 illustrates strip 360, a third alternative embodiment of strip 60. Strip 360 is similar to strip 60 except that strip 60 includes segments 361, 363 and cord 365. Segments 361 and 363 are substantially identical to strip 60 except that segment 361 includes male projection 367 and segment 363 includes female cavity 369. Male projection 367 extends from an axial end of segment 361 and is configured for being nonrotatably received within female cavity 369 such that shoulder 371 abuts against the axial end of segment 363. Male projection 367 and female cavity 369 mate to secure segments 361 and 363 in a fixed end-to-end relationship such that segments 361 and 363, collectively, can be placed in tension and compression so as to function substantially identical to strip 60. Segments 361 and 363 are retained together by cord 365.

Cord 365 comprises a resiliently flexible elastic cord, commonly referred to as a bungee cord, having axial ends affixed or coupled to segments 361 and 363. Cord 365 has an axial length and is affixed to segment s 361 and 363 such that cord 365 resiliently biases male projection 367 into female cavity 369 to maintain segments 361 and 363 coupled to one another. In the exemplary embodiment shown in FIG. 12, cord 365 is illustrated in a stretched condition wherein cord 365 is exerting a force tending to pull male projection 367 into female cavity 369.

At the same time, however, cord 365 is stretchable to enable segments 361 and 365 to be sufficiently separated or to be folded adjacent to one another. To separate segments 361 and 363 to collapse strip 360, segments 361 and 363 are pulled apart in the direction indicated by arrow 373.

Although the present invention has been described with reference to preferred embodiments, workers skilled in the art will recognize that changes may be made in form and detail without departing from the spirit and scope of the invention. The present invention described with reference to the preferred embodiments and set forth in the following claims is manifestly intended to be as broad as possible. For example, unless specifically otherwise noted, the claims reciting a single particular element also encompass a plurality of such particular elements. This invention is not limited to the methods of implementation that have been explicitly described, but it includes the various variants and generalizations contained in the following claims.

What is claimed is:

1. A canopy structure comprising:

a plurality of support beams, each support beam including:

an elongate spine extending in an arc;

first and second flexible tension panels extending from the spine;

a sleeve, wherein the spine is continuously bound by the sleeve; and flexible connecting panels extending between and interconnecting the first and second tension panels of adjacent support beams, wherein the first and second tension panels divergently extend from the spine and between the spine and one of the flexible connecting panels, wherein the first and second tension panels connect to the the flexible connecting panels along first and second spaced lines.

2. The canopy structure of claim 1 wherein the arc has an apex and wherein the first and second tension panels diverge from one another from the spine at a first acute angle proximate the apex and at a second larger acute angle distant the apex.

3. The canopy structure of claim 1 wherein the plurality of support beams includes first and second support beams which cross one another at an intersection.

4. The canopy structure of claim 3 wherein in the first tension panel of the first support beam and the second tension panel of the second support beam extend substantially perpendicular to one another at the intersection.

5. The canopy structure of claim 1 wherein each spine comprises a strip that has a first longitudinal length and a first transverse width extending within a first plane, wherein the strip is resiliently flexible in a direction non-parallel to the plane and inflexible in a direction parallel to the plane, and wherein the strip is arcuately deformed along its longitudinal length so as to extend along the arc.

6. The canopy structure of claim 1 wherein each spine is removably coupled to the first and second tension panels.

7. The canopy structure of claim 6 wherein the spine is sufficiently flexible so as to be coiled upon being removed from the first and second panels.

8. The canopy structure of claim 1 wherein each support beam includes a sleeve coupled to the first and second tension panels and configured to removably receive the spine.

9. The canopy structure of claim 8 wherein the sleeve extends along a substantial portion of a longitudinal length of the spine.

10. The canopy structure of claim 8 including means for retaining the spine within the sleeve.

11. The canopy structure of claim 10 wherein a sleeve has an opening and wherein the canopy structure includes a buckle on a first side of the opening and a strap having an end coupled to the canopy structure on a second side of the opening, wherein the strap extends across the opening and engages the buckle to retain the spine in the sleeve.

12. A canopy structure comprising:

a canopy including:

a plurality of arcuately extending sleeves;

first and second flexible tension panels extending from the sleeves non-parallel to one another;

flexible connecting panels between and interconnecting the first and second tension panels of adjacent sleeves, respectively; and an elongate spine removably received within each sleeve, wherein each spine comprises a strip that has a first longitudinal length and a first transverse width extending within a plane, wherein the strip is resiliently flexible in a direction non-parallel to the plane and inflexible in a direction parallel to the plane, and wherein the strip is arcuately deformed along its longitudinal length when inserted into its respective sleeve.

13. A canopy structure comprising:

a canopy including:

a plurality of arcuately extending sleeves;

first and second flexible tension panels extending from the sleeves non-parallel to one another; and flexible connecting panels between and interconnecting the first and second tension panels of adjacent sleeves, respectively; and an elongate spine removably received within each sleeve, wherein the spine is continuously bound by the sleeve.

14. The canopy structure of claim 13 wherein the elongate spine is resiliently flexible and is deformed along its longitudinal length into an arc when inserted into its respective sleeve.

15. The canopy structure of claim 13 wherein each spine comprises a strip that has a first longitudinal length and a first transverse width extending within a plane, wherein the strip is resiliently flexible in a direction non-parallel to the plane and inflexible in a direction parallel to the plane, wherein the strip is arcuately deformed along its longitudinal length when inserted into its respective sleeve.

16. A canopy structure comprising:

a first elongate strip having a first longitudinal length and a first transverse width extending within a first plane, wherein the first strip is resiliently flexible in a direction non-parallel to the plane and inflexible in a direction parallel to the plane, wherein the first strip is arcuate along its longitudinal length;

a second elongate strip crossing the first elongate strip, the second elongate strip having a second longitudinal length and a second transverse width extending within a second arcuate plane, wherein the second strip is resiliently flexible in a direction non-parallel to the second plane and inflexible in a direction parallel to the second plane, wherein the second strip is arcuate along its longitudinal length; and at least one flexible panel coupled to the first and second strips between the first and second strips, wherein the at least one panel includes:

first and second tension panels extending from the first strip non-parallel to the first plane;

third and fourth tension panels extending from the second strip non-parallel to the second plane, wherein the canopy structure has an apex, and wherein the first tension panel and the third tension panel are joined to one another at the apex; and connecting panels interconnecting the first and third tension panels and the second and fourth tension panels.

17. The canopy structure of claim 16 wherein the at least one panel includes:

first and second tension panels divergently extending from the first strip oblique to the first plane;

third and fourth tension panels divergently extending from the second strip oblique to the second plane; and connecting panels interconnecting the first and third tension panels and the second and fourth tension panels, wherein the connecting panels are joined to the first, second, third and fourth tension panels along first, second, third and fourth spaced lines, respectively.

18. The canopy structure of claim 16 including:

a first sleeve between the first and second tension panels, wherein the first sleeve receives the first strip; and a second sleeve between the third and fourth tension panels, wherein the second sleeve receives the second strip.

19. The canopy structure of claim 18 wherein the first strip is removable from the first sleeve and wherein the second strip is removable from the second sleeve.

20. The canopy structure of claim 19 wherein the first and second strips are sufficiently flexible so as to be coiled upon being removed from the first and second sleeves, respectively.

21. The canopy structure of claim 19 including means for retaining the first and second strips at least partially within the first and second sleeves, respectively.

22. The canopy structure of claim 21 wherein the first sleeve includes:

a first buckle on a first side of the first sleeve; and a strap having an end coupled to the structure on a second side of the first sleeve, wherein the strap engages the first buckle to retain the first strip in the first sleeve.

23. The canopy structure of claim 16 wherein the second strip crosses the first strip equidistant opposite ends of the first strip.

24. The canopy structure of claim 16 wherein the first and second strips have ends terminating in a common third plane, wherein the first and second strips cross one another in a fourth plane and wherein the at least one flexible panel includes connector panels that are resiliently stretchable in directions perpendicular and parallel to the first and second planes.

25. The canopy structure of claim 24 wherein the connector panels are unstretchable in directions 45 degrees relative to the third and fourth planes.

26. The canopy structure of claim 16 wherein the first strip includes a first segment and a second segment coupled to the first segment, wherein the first and second segments move between a first position in which the first and second segment extend end-to-end and second position in which the first and second segment extend side-by-side one another.

27. The canopy structure of claim 26 wherein the first and second segments are pivotably coupled to one another.

28. The canopy structure of claim 27 including:

an intermediate connector segment pivotably coupled to the first segment and pivotably coupled to the second segment; and a locking mechanism movably coupled to one of the first segment, the second segment and the intermediate segment, wherein the locking mechanism moves between a first locking position in which the locking mechanism prevents pivotable movement of the first segment relative to the second segment and a second position in which the locking mechanism allows pivotable movement of the first segment relative to the second segment.

29. The canopy structure of claim 28 when the locking mechanism comprises a sleeve.

30. The canopy structure of claim 27 wherein the first segment includes a male projection and a pin projecting from the male projection and wherein the second segment includes a female cavity and a slot to receive and guide movement of the pin, wherein the female cavity nonrotatably receives the male projection to the first and second segments in an end-to-end relationship and wherein the slot guides movement of the pin and location of the pin to enable the first segment to be repositioned in a side-by-side relationship with the second segment.

31. The canopy structure of claim 26 wherein the first segment includes a male projection and wherein the second segment includes a female projection configured to nonrotatably receive the male projection to couple the first and second segments in an end-to-end relationship.

32. The canopy structure of claim 30 including a resiliently flexible cord connecting the first and second segments, wherein the cord resiliently biases the first segment towards the second segment in the end-to-end relationship.

33. A canopy structure comprising:

a first elongate strip having a first longitudinal length and a first transverse width extending within a first plane, wherein the first strip is resiliently flexible in a direction non-parallel to the plane and inflexible in a direction parallel to the plane, wherein the first strip is arcuate along its longitudinal length;

a second elongate strip crossing the first elongate strip, the second elongate strip having a second longitudinal length and a second transverse width extending within a second arcuate plane, wherein the second strip is resiliently flexible in a direction non-parallel to the second plane and inflexible in a direction parallel to the second plane, wherein the second strip is arcuate along its longitudinal length; and at least one flexible panel coupled to the first and second strips between the first and second strips, wherein the first and second strips have ends terminating in a common third plane, wherein the first and second strips cross one another in a fourth plane and wherein the at least one flexible panel includes connector panels that are resiliently stretchable in directions perpendicular and parallel to the first and second planes.

34. The canopy structure of claim 33 wherein the connector panels are formed from a fabric material having perpendicular weaves and wherein the fabric material is oriented such that the weaves extend diagonally between the first strip and the second strip.

35. A canopy structure comprising:

a plurality of support beams, each support beam including:

an elongate spine extending in arc having an apex;

first and second flexible tension panels extending from the spine; and flexible connecting panels extending between and interconnecting the first and second tension panels of adjacent support beams wherein the first and second tensions panels divergently extend from the spine and between the spine and one of the flexible connecting panels, wherein the first and second tension panels connect to the flexible connecting panels along first and second spaced lines, and wherein the first and second tension panels diverge from one another from the spine at a first acute angle proximate the apex and at a second larger acute angle distant the apex.

36. A canopy structure comprising:

a plurality of support beams, each support beam including:

an elongate spine extending in an arc;

first and second flexible tension panels extending from the spine; and flexible connecting panels extending between and interconnecting the first and second tension panels of adjacent support beams, wherein the first and second tension panels divergently extend from the spine and between the spine and one of the flexible connecting panels, wherein the first and second tension panels connect to the flexible connecting panels along first and second spaced lines, wherein each spine comprises a strip that has a first longitudinal length and a first transverse width extending within a first plane, wherein the strip is resiliently flexible in a direction non-parallel to the plane and inflexible in a direction parallel to the plane, and wherein the strip is arcuately deformed along its longitudinal length so as to extend along the arc.

37. A canopy structure comprising:

a plurality of support beams, each support beam including:

an elongate spine extending in an arc;

first and second flexible tension panels extending from the spine; and flexible connecting panels extending between and interconnecting the first and second tension panels of adjacent support beams, wherein the first and second tension panels divergently extend from the spine and between the spine and one of the flexible connecting panels, wherein the first and second tension panels connect to the flexible connecting panels along first and second spaced lines, wherein each spine is removably coupled to the first and second tension panels, and wherein the spine is sufficiently flexible so as to be coiled upon being removed from the first and second panels.

38. A canopy structure comprising:

a plurality of support beams, each support beam including:

an elongate spine extending in an arc;

first and second flexible tension panels extending from the spine;

a sleeve coupled to the first and second tension panels and configured to removably receive the spine, wherein the sleeve has an opening;

a buckle on a first side of the opening and a strap having an end coupled to the canopy structure on a second side of the opening, wherein the strap extends across the opening and engages the buckle to retain the spine in the sleeve; and flexible connecting panels extending between and interconnecting the first and second tension panels of adjacent support beams, wherein the first and second tension panels divergently extend from the spine and between the spine and one of the flexible connecting panels, and wherein the first and second tension panels connect to the flexible connecting panels along first and second spaced lines.

* * * * *